US006799336B2

(12) United States Patent
Freeman

(10) Patent No.: US 6,799,336 B2
(45) Date of Patent: Oct. 5, 2004

(54) SINK SUPPORT SHELL APPARATUS AND METHOD OF MAKING A PROTECTIVE SINK SUPPORT SHELL

(76) Inventor: William D. Freeman, 13815 Kleberg Rd., Dallas, TX (US) 75253

( * ) Notice: Subject to any disclaimer, the term of this patent is extended or adjusted under 35 U.S.C. 154(b) by 0 days.

(21) Appl. No.: 10/227,917

(22) Filed: Aug. 26, 2002

(65) Prior Publication Data

US 2004/0034923 A1 Feb. 26, 2004

(51) Int. Cl.[7] ..... A47K 1/04

(52) U.S. Cl. ..... 4/619; 4/632; 4/633; 4/635; 4/640; 4/651; 4/695; 4/548

(58) Field of Search ..... 4/619, 632, 633, 4/635, 640, 651, 695, 548

(56) References Cited

U.S. PATENT DOCUMENTS

| | | | | | |
|---|---|---|---|---|---|
| 331,271 | A | * | 12/1885 | Austin | 220/23.88 |
| 1,408,830 | A | * | 3/1922 | Rowe | 4/619 |
| 1,842,289 | A | * | 1/1932 | Russel | 4/641 |
| 2,205,018 | A | * | 6/1940 | Francis | 4/641 |
| 4,336,620 | A | * | 6/1982 | Gresh | 4/639 |
| 4,462,126 | A | * | 7/1984 | Cleaveland | 4/619 |
| 4,779,605 | A | * | 10/1988 | Smith et al. | 126/33 |
| 5,301,376 | A | * | 4/1994 | Herbert | 4/626 |
| 6,000,673 | A | * | 12/1999 | Bordener | 249/53 R |
| D443,683 | S | * | 6/2001 | Freeman | D23/293.1 |

* cited by examiner

*Primary Examiner*—Henry Bennett
*Assistant Examiner*—Azy Kokabi
(74) *Attorney, Agent, or Firm*—Stephen J. Walder, Jr.; Duke W. Yee

(57) ABSTRACT

A sink support shell apparatus and method of making a sink support shell are provided. The sink support shell apparatus is a shell shaped to be compatible with the sink that is to be placed in the sink support shell. The sink support shell includes a rim for mounting the shell either above or below the countertop level. The shell further includes an overflow/vent channel and stand-off in the base for attaching the shell to the necessary plumbing fixtures to allow for drainage of the water from the sink. The overflow/vent channel is formed in the material of the shell and allows water to flow down the channel to be drained by the attached plumbing fixtures as well as air to be vented to reduce suction noise. The sink support shell is made of high-impact material, such as a metal or hard plastic material.

20 Claims, 5 Drawing Sheets

SINK SUPPORT SHELL APPARATUS AND METHOD OF MAKING A PROTECTIVE SINK SUPPORT SHELL

BACKGROUND OF THE INVENTION

1. Technical Field

The present invention is directed to a sink support shell apparatus and a method of making a sink support shell.

2. Description of Related Art

The desire of owners of homes, recreational vehicles, boats, aircraft, and the like, to decorate their home/vehicle with unique and elegant fixtures leads manufacturers and interior decorators to use more unique and expensive materials in the creation of such fixtures. This is especially true in the area of bathroom and kitchen fixtures.

One such material used in the creation of bathroom and kitchen sinks is marble and various types of stone, such as granite. However, the use of marble and stone sinks for the average customer is price and weight prohibitive. The average marble or stone sink weighs as much as 80 pounds due to the amount of material required to provide the necessary strength against breakage and impact. In addition, due to the amount of material used in the fabrication of such sinks, the installed cost can be upwards of five thousand dollars.

This large weight limits the uses of such marble and stone sinks since weight can greatly affect the performance of aircraft, boats, recreational vehicles, and other potential locations where such sinks might be installed.

Because of the expense and weight issues surrounding the use of such materials in providing elegant interiors, customers often elect to make use of imitation materials that are less costly and less heavy. However, these materials do not provide the same aesthetic quality that the natural marble and stone materials provide.

Thus, it would be beneficial to have an apparatus that would allow for lighter and less costly use of materials, such as marble and stone, in the fabrication of sinks. Moreover, it would be beneficial to have a method of making such an apparatus.

SUMMARY OF THE INVENTION

The present invention provides a sink support shell apparatus and method of making a sink support shell. The sink support shell apparatus according to the present invention is a shell shaped to be compatible with the sink that is to be placed in the sink support shell (hereafter referred to as the "shell"). The sink support shell includes a rim for mounting the shell either above or below the countertop level. The sink sits in shell and is attached to the shell by a waterproof adhesive, such as silicon glue.

The shell further includes an overflow/vent channel and stand-off in the base for attaching the shell to the necessary plumbing fixtures to allow for drainage of the water from the sink. The overflow/vent channel is formed in the material of the shell and allows water to flow down the channel to be drained by the attached plumbing fixtures. In addition, the overflow/vent channel provides an air channel that prevents pressure build up in the plumbing fixtures and suction noise during draining of the sink.

The sink support shell is made of high-impact material, such as a metal or hard plastic material. In a preferred embodiment, the sink support shell is formed from a hard plastic material. The hard plastic sink support shell may be created using thermal formed plastic in which a heated sheet of plastic is placed over a mold of the sink and cooled such that the plastic sheet takes on the form of the sink. Thereafter, the rim, overflow/vent channel, stand-off and drainage hole maybe formed by tooling the cooled plastic shell.

The high-impact material provides protection for the sink from impacts on the underside of the sink. In addition, the sink support shell provides a leak proof support in the event of cracks or breaks in the sink due to impacts on the upper surface of the sink. Moreover, the sink support shell provides a more aesthetically pleasing exterior for the underside of the sink.

Most importantly, the sink support shell of the present invention provides a support that provides strength and protection to the sink and thereby allows the sink to be fashioned from less material than prior art sinks. That is, because the sink support shell of the present invention provides the protection and strength needed to mount the sink to the countertop, protect against impacts, and the like, the sink may be fabricated from a thinner material. As a result, the weight and cost of the sink is reduced making it more affordable to customers and less of a concern with regard to installation in locations where weight is an issue.

These and other features and advantages of the present invention will be described in, or will become apparent to those of ordinary skill in the art in view of, the following detailed description of the preferred embodiments.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE PREFERRED EMBODIMENTS

The present invention provides a sink support shell and a method of making a sink support shell. The present invention is especially suited for use with sinks that are typically fabricated from heavy and/or expensive materials such as marble, granite and other stone materials, metal, glass, ceramics and the like. While the present invention is especially suited for such sinks, the present invention is not limited to such. It should be appreciated by those of ordinary skill in the art while reviewing the exemplary embodiments disclosed herein, that the present invention may be used with sinks of any material and configuration.

Figure 1A:
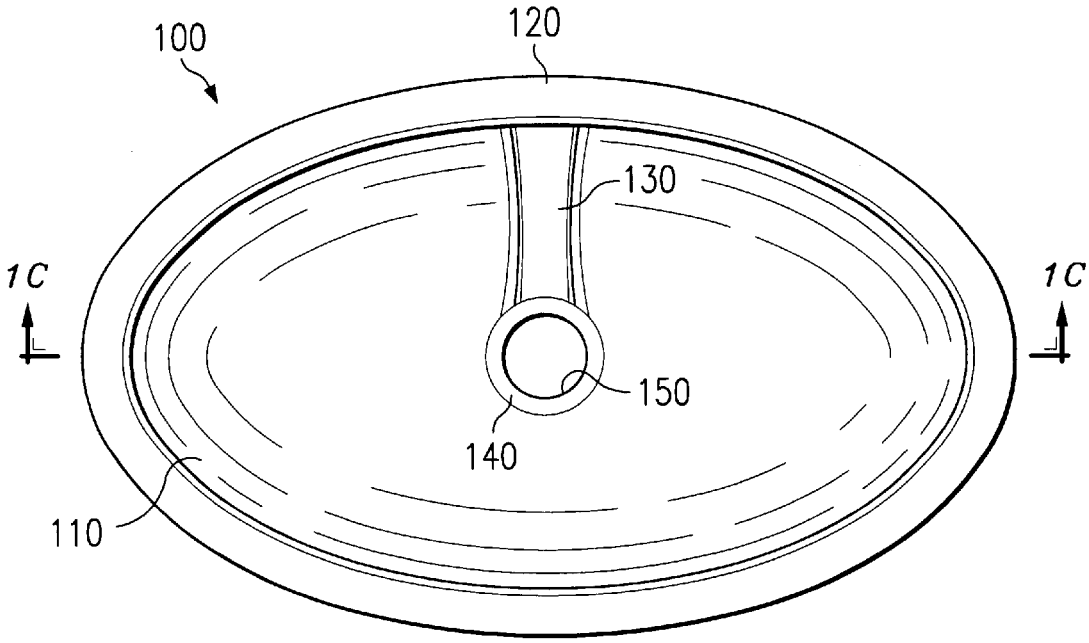
FIG. 1A is an exemplary diagram illustrating a top-down view of a sink support shell according to an exemplary embodiment of the present invention.
Figure 1B:
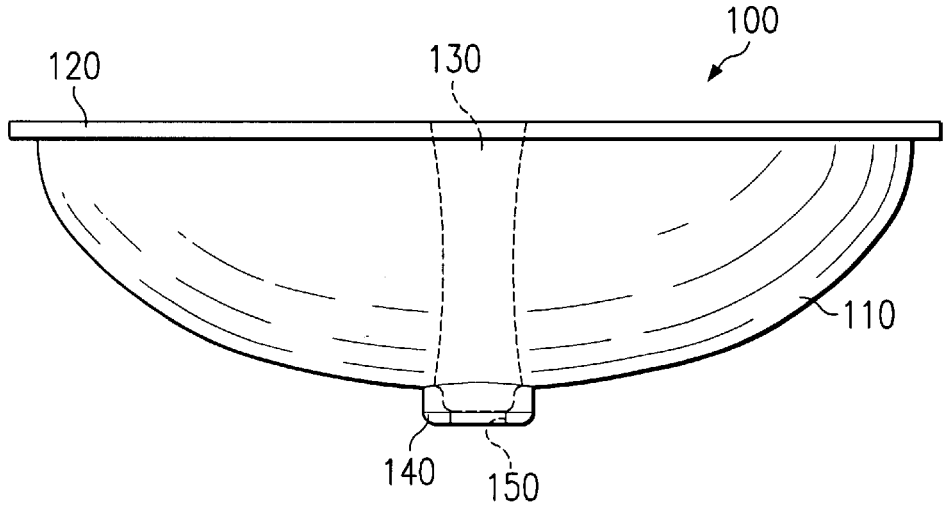
FIG. 1B is an exemplary diagram of a front view of the sink support shell according to the exemplar embodiment of the present invention shown in FIG. 1A.
Figure 1C:
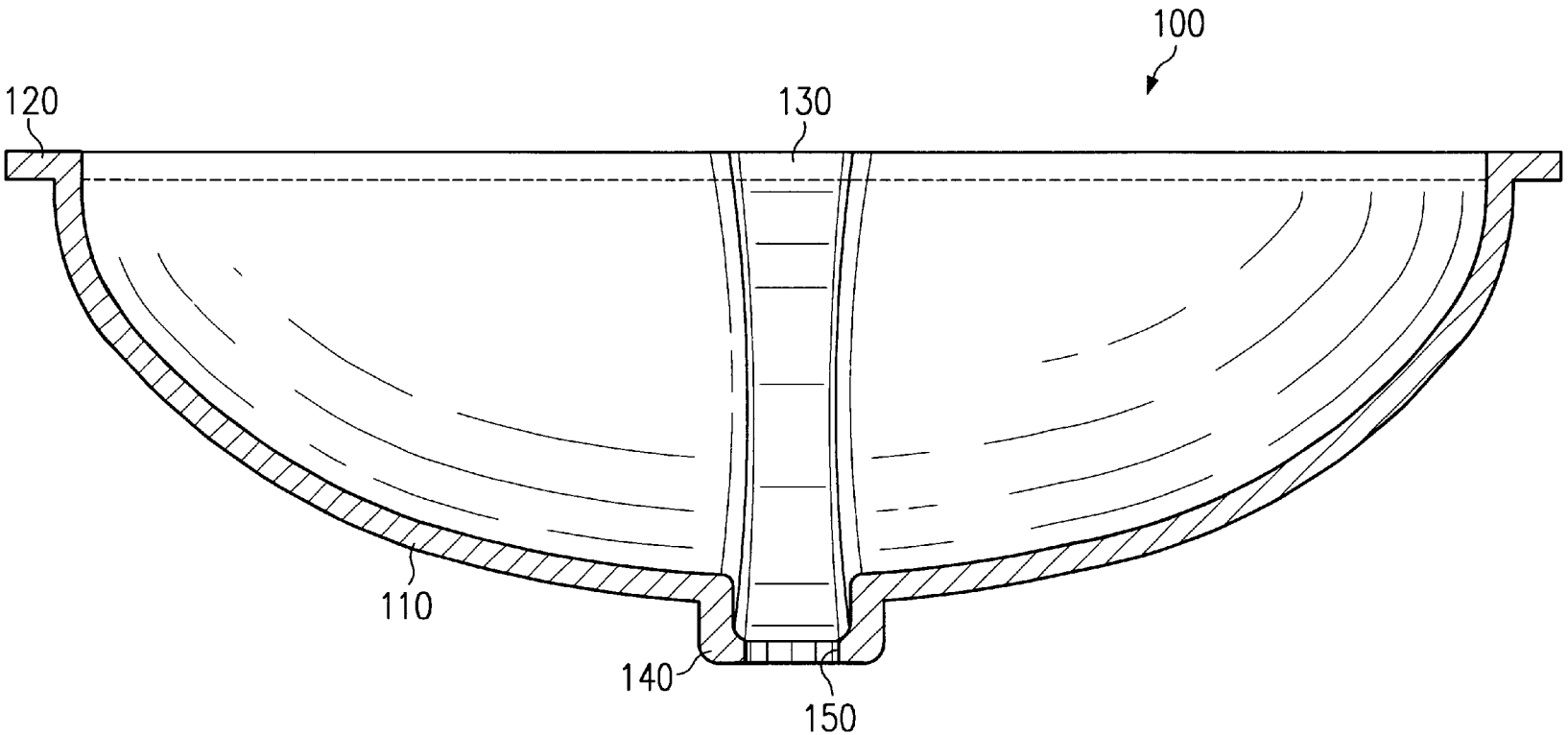
FIG. 1C is an exemplary cross-sectional view of the sink support shell according to the exemplary embodiment shown in FIG. 1A.

FIGS. 1A–1B illustrate a sink support shell apparatus according to an exemplary embodiment of the present invention. FIG. 1A is an exemplary diagram illustrating a top-down view of a sink support shell according to an exemplary embodiment of the present invention. FIG. 1B is an exemplary diagram of a front view of the sink support shell according to the exemplar embodiment of the present invention shown in FIG. 1A. FIG. 1C is an exemplary cross-sectional view of the sink support shell according to the exemplary embodiment shown in FIG. 1A. These figures will be referenced together through the use of the common reference numbers in the following description.

As shown in FIGS. 1A–1C, the sink support shell 100 includes a first portion 110 that is formed and configured to conform to a shape of a bowl of a sink that is to be placed inside the concave portion of the sink support shell 100.

By stating that the sink support shell 100 is configured to conform to a bowl of a sink, what is meant is that the dimensions, curvature, shape, and the like of the bowl portion 110 of the sink support shell 100 are matched to that of a sink with which the sink support shell 100 is designed to be used. Preferably, the shape and configuration of the sink support shell 100 compliments the shape of the sink such that there is minimal gap between the surface of the sink and the concave surface of the bowl portion 110 of the sink support shell 100 when the sink is placed inside the concave opening of the sink support shell 100, with the exception of the overflow/vent channel 130, discussed hereafter. Any gaps that may be present may be filled with a silicon glue or other type of sealant that both seals the junction between the sink and the sink support shell 100 and adhesively attaches the sink to the sink support shell 100 so that the sink does not move relative to the sink support shell 100.

On a top edge of the bowl portion 110 of the sink support shell 100 is provided a rim 120 that extends out beyond the top edge. The rim 120 is provided as mechanism by which the sink support shell 100 may be attached to a substrate, such as a cabinet or countertop support structure. The sink support shell 100 may be attached to either a top side or a bottom side of the substrate using the rim 120. For example, a silicon glue may be used on a surface of the rim 120 to glue the rim 120, and subsequently the sink support shell 100, to a top or bottom surface of the substrate. Alternatively, holes may be provided in the rim 120 such that the sink support shell 100 may be fastened to the substrate by way of bolts, screws, or other similar fastening devices. Moreover, the rim 120 may provide a surface by which the sink support shell may be attached via one or more clips to the substrate such as clips that are glued or drilled into the substrate. Such clips are generally known in the art.

Also provided is a stand-off 140 for coupling the sink support shell 100 to existing plumbing fixtures, such as a drainage pipe or the like. The stand-off 140 has an opening 150. A drain attachment may extend through an opening in the sink, through opening 150 in the stand-off 140 of the sink support shell 100 and may contact the existing plumbing fixtures and be coupled to them. The contact between the sides of the opening 150 in the stand-off 140 and the drain attachment may be sealed using a sealant for waterproofing the contact.

An overflow/vent channel 130 is provided in the bowl portion 110 of the sink support shell 100. In a preferred embodiment, the overflow/vent channel 130 extends from the top edge of the bowl portion 110 to the opening 150 in the stand-off 140. The overflow/vent channel 130 provides a channel through which fluid may flow in the event of an overflow fluid level occurring in the sink. In such a case, the fluid may flow down the channel to the opening 150 in the stand-off 140 and drain out the drain attachment (which typically has openings provided therein) and plumbing fixture to which it is attached through the opening 150. The fluid may enter the overflow/vent channel 130 from the sink through an overflow opening in the sink.

In addition to providing a channel through which fluid may flow in the case of an overflow condition, the overflow/vent channel 130 provides an air channel during non-overflow conditions that suppresses suction noise during drainage of fluid down the plumbing fixture via the opening 150 in the stand-off 140.

The sink support shell 100 is preferably fashioned from a high-impact material such as a metal or hard plastic material. While the preferred embodiment shown in FIGS. 1A–1C shows the sink support shell 100 being formed from a single piece of high-impact material, the present invention is not limited to such. Rather, the present invention may be fashioned from any number of separate portions that are coupled and sealed so as to provide a shell structure for supporting a sink.

In fabricating the sink support shell 100 any method of fabricating a shell structure may be used to fabricate the sink support shell 100. Some such methods include, for example, injection molding, thermally formed plastic techniques, laid fiberglass, stamped metal and the like.

In a preferred embodiment, the sink support shell 100 is fabricated using a thermally formed plastic technique. In such a technique, a mold of the sink with which the sink support shell 100 is to be used, is provided. Holes are drilled in the mold to provide for suction in a later step of the process.

A single sheet of plastic is then heated to a high temperature to make the plastic pliable. The heated plastic sheet is then applied to the sink mold such that the plastic sheet covers the sink mold. Suction is applied to the interior of the sink mold thereby causing the plastic sheet to adhere to the sink mold as much as possible. In this way, the plastic sheet takes on the shape of the sink mold.

As the plastic sheet cools, the plastic material becomes hardened. The hardened plastic material is removed from the sink mold and tooled to smooth the edges, remove excess material and create the rim 120. In addition, tooling is performed on the hardened plastic material to create the overflow/vent channel 130, the stand-off 140 and the opening 150 in the stand-off 140. After tooling in this manner, the sink support shell 100 is ready for use.

Figure 2:
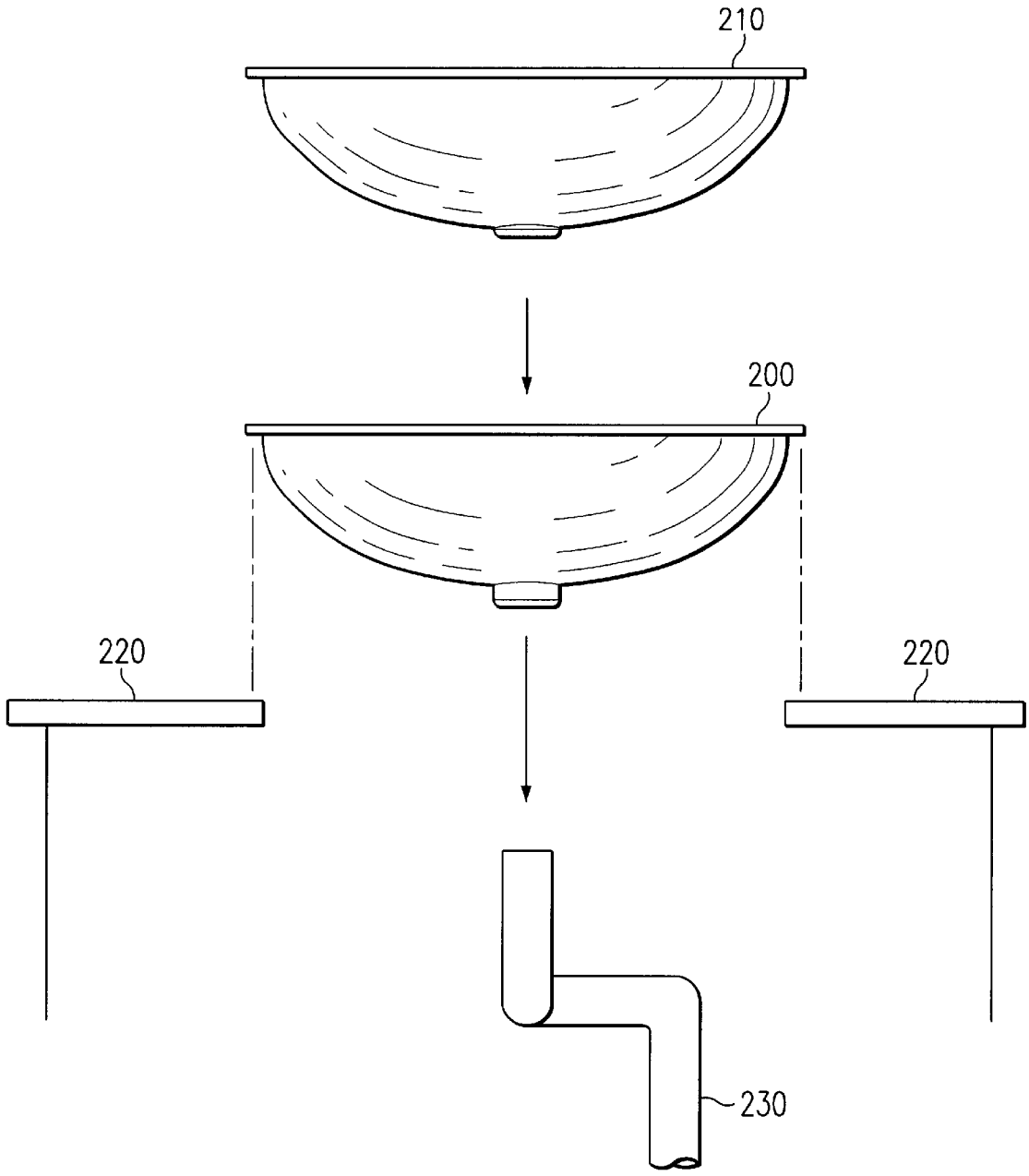
FIG. 2 is an exemplary diagram illustrating installation of the sink using the sink support shell of the present invention according to one embodiment of the present invention.

As mentioned previously, the rim 120 of the sink support shell 100 provides for mounting of the sink support shell 100 to either a top or bottom side of a substrate, such as a structure associated with a cabinet or countertop. FIG. 2 illustrates the installation of a sink, using the sink support shell of the present invention, where the sink support shell is mounted to a top surface of a substrate.

With reference to FIG. 2, it should be appreciated that the sink may be already assembled with the sink support shell 200 prior to installation. For example, a manufacturer may manufacture both the sink and the sink support shell 200 and assemble them prior to shipping to a customer. Alternatively, the manufacturer may manufacture one or both of the sink and sink support shell 200 and ship them to a third party vendor that assembles the sink and the sink support shell 200 prior to subsequent delivery to an installer of the sink structure.

In yet another alternative, the sink and sink support shell 200 may be provided as two separate units to an installer who is responsible for assembling the sink and sink support shell 200 and installing them in a cabinet or countertop. Regardless of the particular alternative taken, the result is that the sink support shell 200 is mounted to the substrate with the sink being held within the sink support shell 200. For purposes of illustration, however, it will be assumed that the sink and sink support shell 200 are provided to an installer as two separate units that are assembled during installation.

As shown in FIG. 2, the installation of the sink 210 involves mounting the sink support shell 200 to the top side of the substrates 220 and connecting the sink support shell 200 to the existing plumbing fixture 230. While FIG. 2 illustrates only the left and right sides of the sink support shell 200 being mounted to the substrates 220, it should be appreciated that the sink support shell 200 will typically be placed in an opening made in the top surface of the substrate 220. Thus, substrate surfaces will surround the sink support shell 200 and the sink support shell 200 will be fastened to the substrate 220 everywhere the rim of the sink support shell 200 abuts the substrate 220. The sink support shell 200 may be fastened to the substrate 220 by placing silicon glue or other waterproof adhesive material between the bottom surface of the rim of the sink support shell 200 and the top surface of the substrate 220.

Alternatively, fasteners, such as bolts and/or screws, may be used to attach the sink support shell 200 to the substrate 220 through holes fashioned in the rim of the sink support shell 200. Of course, it would still be beneficial to waterproof the coupling between the sink support shell 200 and the substrate 220 with a waterproof material, such as silicon or caulk. The connection between the plumbing fixture 230 and the sink support shell 200 may also be sealed and waterproofed through the use of silicon glue, a waterproof adhesive, or the like.

Either before or after the sink support shell 200 is mounted and fastened into place, the sink 210 may be placed in the sink support shell 200. The sink 210 is preferably aligned so that the drainage hole in the sink 210 matches the drainage hole present in the stand-off of the sink support shell 200 and the plumbing fixture 230. Additionally, the sink 210 is preferably positioned so that an overflow hole in the sink, or other overflow mechanism, is aligned with the overflow/vent channel formed in the sink support shell 200. The sink 210 may be sealed and fastened to the sink support shell 200 using silicon glue, a waterproof adhesive, or the like.

The sink 210 and sink support shell 200 may be secured to the plumbing fixture 230 by way of a drain assembly (not shown) that is inserted into the hole of the sink and which passes through the stand-off to connect with the plumbing fixture 230. Such drain assemblies are generally known in the art and thus, a detailed description is not provided herein.

Figure 3:
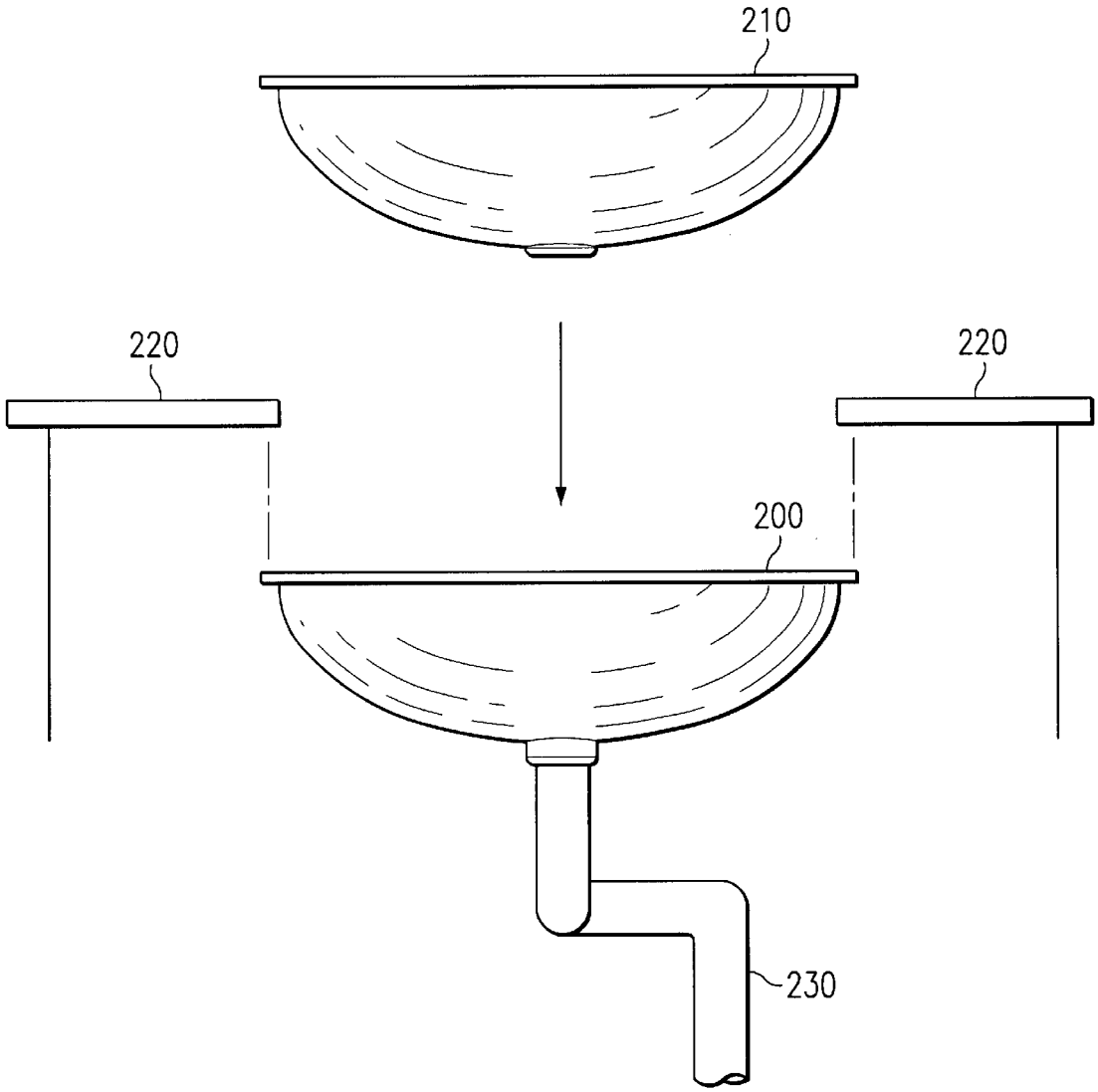
FIG. 3 is an exemplary diagram illustrating installation of the sink using the sink support shell of the present invention according to one embodiment of the present invention.

FIG. 3 is an exemplary diagram illustrating installation of a sink, using the sink support shell of the present invention, where the sink support shell is fastened to a bottom side of a substrate. The installation of the sink 210 is similar to that shown in FIG. 2 with the differences between the two mounting possibilities being that the sink support shell 200 is fastened to a bottom or underside of the substrate 220 and that a lip of the sink 210 is fastened to a top surface of the substrate 220. In such an embodiment, the sink 210 and sink support shell 200 are formed taking into account the width of the substrate 220 so that the sink 210 and sink support shell 200 still abut one another as much as possible.

With the use of the sink support shell 200 of the present invention, the sink 210 may be fashioned from a thinner and less costly amount of material that prior art sinks. That is, because the sink support shell of the present invention provides the protection and strength needed to mount the sink to the countertop, protect against impacts, and the like, the sink may be fabricated from a thinner material. As a result, the weight and cost of the sink is reduced making it more affordable to customers and less of a concern with regard to installation in locations where weight is an issue. Thus, with the use of the present invention, owners of aircraft, boats, recreational vehicles, and the like may now have the elegance of real marble and/or stone sinks with less cost and less concern regarding performance due to weight issues.

While the primary embodiment described above illustrates the sink support shell and the sink to be oval in shape, the present invention is not limited to such. Rather, the sink support shell and sink may take any configuration desired without limitation. Thus, the sink support shell of the present invention can be formed to be compatible with any geometry of sink. One such sink geometry is a multifaceted sink as described hereafter.

Figure 4A:
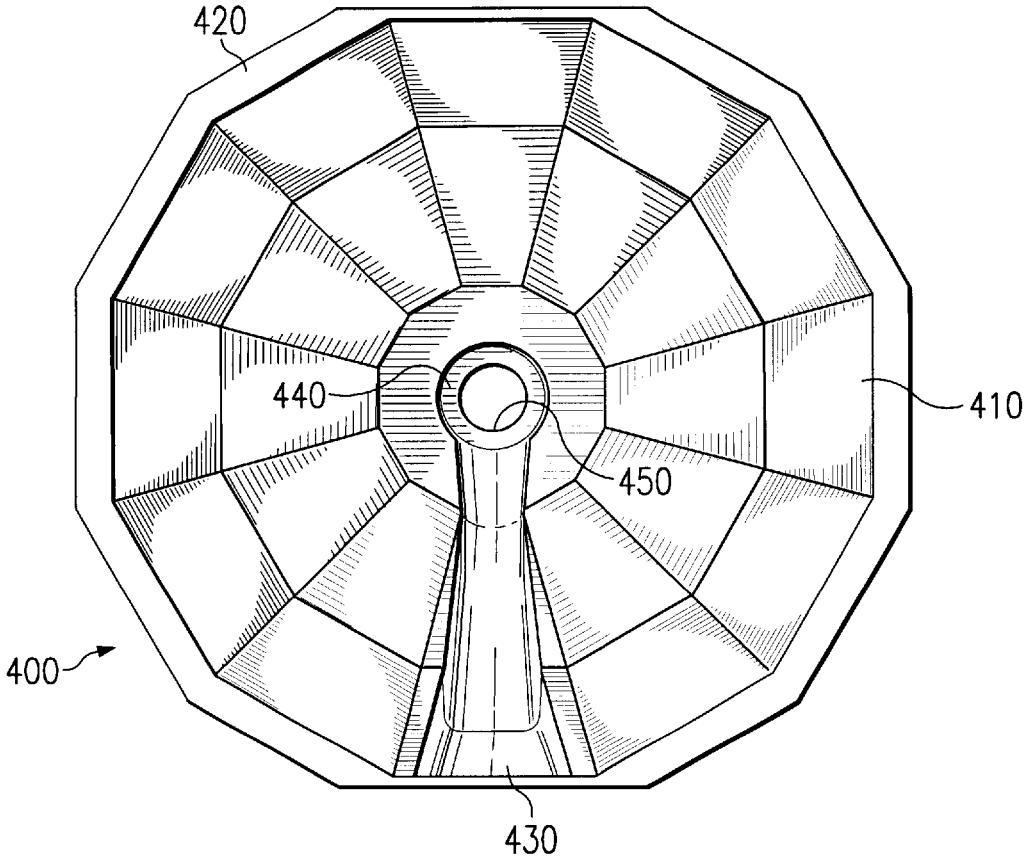
FIG. 4A is an exemplary diagram illustrating a top-down view of a faceted sink support shell in accordance with another embodiment of the present invention.
Figure 4B:
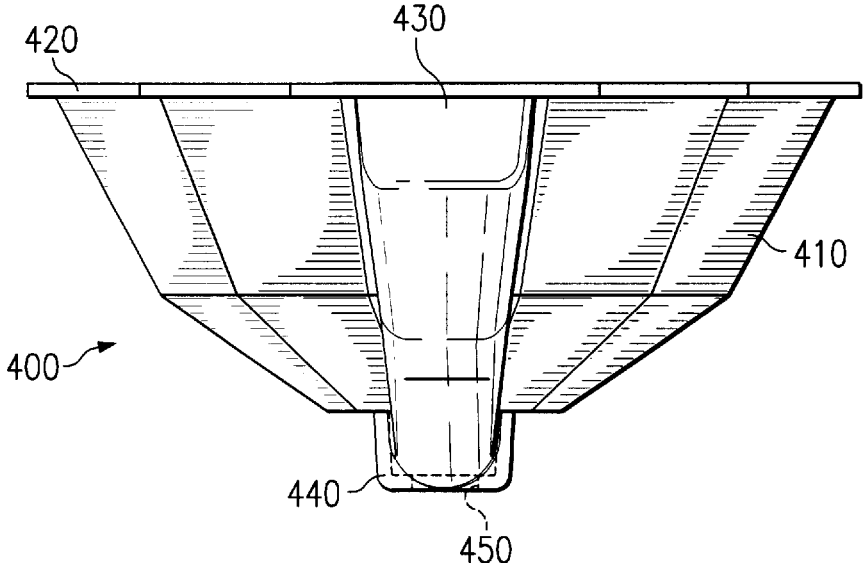
FIG. 4B is an exemplary diagram illustrating a front view of the faceted sink support shell shown in FIG. 4A.

FIG. 4A is an exemplary diagram illustrating a top-down view of a multifaceted sink support shell in accordance with another embodiment of the present invention. FIG. 4B is an exemplary diagram illustrating a front view of the multifaceted sink support shell shown in FIG. 4A. The multifaceted sink support shell shown in FIGS. 4A and 4B is similar to the sink support shell of FIGS. 1A–1C.

The multifaceted sink support shell includes a bowl portion 410, a rim 420, an overflow/vent channel 430, a stand-off 440 and an opening 450 similar to that of FIGS. 1A–1C. However, the bowl portion 410 is formed to have a plurality of facets to accommodate a multifaceted sink, such as that described in U.S. Pat. No. D443,683, entitled "Multi-Faceted Sink", which is commonly owned and hereby incorporated by reference. The rim 420 differs from the rim 120 in that the edge of the rim is not a smooth curve but rather, has a plurality of straight edges at angles to one another in correspondence with the facets in the bowl portion 410 of the sink support shell 400. Of course any other configuration and geometry of sink support shell may be used without departing from the spirit and scope of the present invention and the present invention should not be interpreted to be limited to the exemplary embodiments discussed herein above.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A sink support shell, comprising:

a sink support shell bowl portion configured to receive and support a bowl portion of a sink, wherein the sink is separate from the sink support shell; and a sink support shell rim portion coupled to the sink support shell bowl portion and configured for fastening the sink support shell to a substrate of a cabinet or countertop, wherein the sink support shell is separately formed from the substrate of the cabinet or countertop, and wherein at least one of the sink support shell bowl portion and the sink support shell rim portion provide a surface to which the sink is permanently attached and sealed such that the sink is not moveable relative to the sink support shell when permanently attached and sealed.

2. The sink support shell of claim 1, further comprising:

a stand-off portion coupled to the sink support shell bowl portion for coupling the sink support shell bowl portion to a plumbing fixture.

3. The sink support shell of claim 1, further comprising:

an overflow/vent channel formed in the sink support shell bowl portion.

4. The sink support shell of claim 3, wherein the overflow/vent channel is formed such that the channel terminates in a stand-off portion for coupling the sink support shell bowl portion to a plumbing fixture.

5. The sink support shell of claim 1, wherein the rim portion comprises a rim around a top edge of the sink support shell bowl portion.

6. The sink support shell of claim 1, wherein the sink support shell bowl portion and sink support shell rim portion are made of a high-impact material.

7. The sink support shell of claim 1, wherein the high-impact material is one of a metal material and a plastic material.

8. The sink support shah of claim 1, wherein the sink support shell bowl portion is configured to have a plurality of facets for accommodating a faceted sink.

9. The sink support shell of claim 1, wherein the sink support shell rim portion is configured for attachment to either a top side or a bottom side of the substrate.

10. A method of making a sink support shell, comprising:

providing a sink support shell bowl portion configured to receive and support a bowl portion of a sink, wherein the sink is separate from the sink support shell; and providing a sink support shell rim portion coupled to the sink support shell bowl portion and configured for fastening the sink support shell to a substrate of a cabinet or countertop, wherein the sink support shell is separately formed from the substrate of the cabinet or countertop, and wherein at least one of the sink support shell bowl portion and the sink support shell rim portion provide a surface to which the sink is permanently attached and sealed such that the sink is not moveable relative to the sink support shell when permanently attached and sealed.

11. The method of claim 10, further comprising:

providing a stand-off portion coupled to the sink support shell bowl portion for coupling the sink support shell bowl portion to a plumbing fixture.

12. The method claim 1, further comprising:

providing an overflow/vent channel formed in the sink support shell bawl portion of the sink support shell.

13. The method of claim 3, wherein the overflow/vent channel is formed such that the channel terminates in a stand-off portion for coupling the sink support shell bowl portion to a plumbing fixture.

14. The method of claim 1, wherein providing the sink support shell rim portion comprises providing a rim around a top edge of the sink support shell bowl portion.

15. The method of claim 1, wherein providing the sink support shell bowl portion includes using a thermally formed plastic technique to form the sink support shell bowl portion using a high-impact plastic material.

16. The method of claim 15, wherein providing the sink support shell rim portion includes tooling the high-impact plastic material to form the sink support shell rim portion.

17. The method of claim 1, wherein providing the sink support shell bowl portion includes providing the sink support shell bowl portion with a plurality of facets for accommodating a faceted sink.

18. The method of claim 12, wherein providing the overflow/vent channel includes tooling the sink support shell bowl portion to form the overflow/vent channel in the sink support shell bowl portion.

19. A sink support shell, comprising:

a multi-faceted shell portion having an overflow/vent channel formed therein, the multi-faceted shell portion being configured for receiving and supporting a multi-faceted sink, wherein the multi-faceted sink is separate from the sink support shell;

a rim coupled to a top edge of the multi-faceted shell portion, the rim being configured for attachment to a substrate of a cabinet or countertop; and a stand-off coupled to the multi-faceted shell portion for coupling the sink support shell to a plumbing fixture, wherein the sink support shell is separately formed from the substrate of the cabinet or countertop, and wherein at least one of the multi-faceted shell portion and the rim provide a surface to which the sink is permanently attached and sealed so that the sink is not moveable relative to the sink support shell when permanently attached and sealed.

20. The sink support shell of claim 19, wherein the multi-faceted shell portion, the rim and the stand-off are formed from a high-impact material.

* * * * *

UNITED STATES PATENT AND TRADEMARK OFFICE

CERTIFICATE OF CORRECTION

PATENT NO. : 6,799,336 B2
DATED : October 5, 2004
INVENTOR(S) : William D. Freeman It is certified that error appears in the above-identified patent and that said Letters Patent is hereby corrected as shown below:

Column 7,
Line 32, after "The sink support", please delete "shah", and insert -- shell --.

Column 8,
Line 7, after "support shell", please delete "bawl", and insert -- bowl --.

Signed and Sealed this

Thirteenth Day of September, 2005

JON W. DUDAS
*Director of the United States Patent and Trademark Office*